United States Patent [19]

Poister

[11] 4,301,555

[45] Nov. 24, 1981

[54] REPLACEABLE FILTER FOR DEODORIZING THE AIR FROM A TOILET BOWL

[76] Inventor: Clarence E. Poister, P.O. Box 12232, Wichita, Kans. 67209

[21] Appl. No.: 153,609

[22] Filed: May 27, 1980

[51] Int. Cl.[3] ..... A47K 13/00; E03D 9/04

[52] U.S. Cl. ..... 4/217; 4/222; 4/213

[58] Field of Search ..... 4/217, 214, 213, 216, 4/209, 222, 222.1

[56] References Cited

U.S. PATENT DOCUMENTS

| | | | |
|---|---|---|---|
| 2,849,727 | 9/1958 | Bollinger et al. | 4/217 |
| 3,333,285 | 8/1967 | Null | 4/217 |
| 3,386,109 | 6/1968 | Christian et al. | 4/217 |
| 3,564,624 | 2/1971 | Paley | 4/217 |
| 3,659,296 | 5/1972 | Stamper | 4/217 |
| 3,740,772 | 6/1973 | Paley | 4/217 |
| 3,763,505 | 10/1973 | Zimmerman | 4/213 |
| 3,953,901 | 5/1976 | Poister et al. | 4/217 X |

FOREIGN PATENT DOCUMENTS

| | | | |
|---|---|---|---|
| 610613 | 3/1976 | Switzerland | 4/217 |

*Primary Examiner*—Henry K. Artis
*Attorney, Agent, or Firm*—Edwin H. Crabtree

[57] ABSTRACT

A replaceable filter having activated charcoal or the like therein for deodorizing the air from a toilet bowl. The filter adapted for attachment to the bottom of a toilet seat and providing a seal between the seat and the top of the bowl. Further, the filter may be placed on top of the seat or incorporated inside a hollowed out toilet seat.

8 Claims, 12 Drawing Figures

REPLACEABLE FILTER FOR DEODORIZING THE AIR FROM A TOILET BOWL

BACKGROUND OF THE INVENTION

The subject invention relates generally to a filter for deodorizing the air from a toilet bowl and more particularly to a replaceable filter having activated charcoal or the like therein and adapted for attachment to the bottom of a toilet seat and providing a seal between the seat and the top of the bowl.

Heretofore, there have been various types of deodorizing devices for toilet bowls such as the air conditioning device described in Stamper, U.S. Pat. No. 3,887,948 and a toilet silencer pad described in Winding, U.S. Pat. No. 2,016,419. Also other types of toilet stool deodorizing devices are shown in U.S. Pat. No. 3,153,794 to Hill, U.S. Pat. No. 3,333,285 to Null and U.S. Pat. No. 3,386,109 to Christian et al. None of the above mentioned patents disclose the unique structure and the advantages of the subject replaceable filter as described herein.

SUMMARY OF THE INVENTION

The replaceable filter having activated charcoal or the like therein is simple in design, rugged in construction and is readily adaptable to different types and sizes of toilet bowls and toilet seats.

The replaceable filter may be secured to the bottom of the toilet seat and provides a seal between the seat and the top of the bowl. Further, the filter may include a molded toilet seat having a hollowed out bottom portion for receiving the top and the bottom of the filter therein, thereby providing a combination of replaceable filter with toilet seat. Also, the filter may be placed on top of the toilet seat.

The filter incorporates the use of activated charcoal or the like therein and is releaseably attached to the bottom of the toilet seat. The bottom of the filter may be removed from the top of the filter for the changing of the activated charcoal. Or the bottom of the filter may be bonded to the top of the filter with the charcoal therein. In this case the entire filter is replaced.

The replaceable filter may be connected to a vacuum pump line for withdrawing the deodorized air from the rear of the filter. The filter also may be used without a vacuum pump wherein it includes discharge ports along the outer circumference of the filter for discharging the deodorized air.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
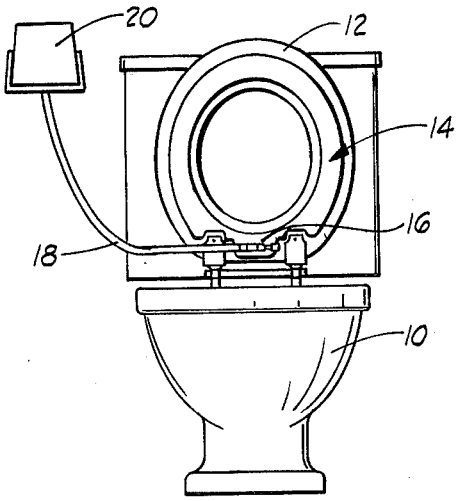
FIG. 1 is a front view of a toilet bowl and toilet seat with the replaceable filter attached to a vacuum pump line.

In FIG. 1 a front view of a toilet bowl 10 is illustrated with a toilet seat 12 in a raised position with the replaceable filter designated by general reference numeral 14 secured to the bottom of the seat 12. The filter 14 includes a neck portion 16 which is adjacent to where the seat 12 is hinged to the back of the toilet bowl 10. The neck portion 16 in this illustration is communicably connected to a vacuum pump line 18 which in turn is attached to a wall mounted vacuum pump 20 for drawing a vacuum in the replaceable filter 14. While the wall mounted vacuum pump 20 is illustrated, any type of vacuum pump either floor mounted, wall mounted or at a remote location may be used to accomplish the purpose of drawing the deodorized air from the filter 14.

Figure 2:
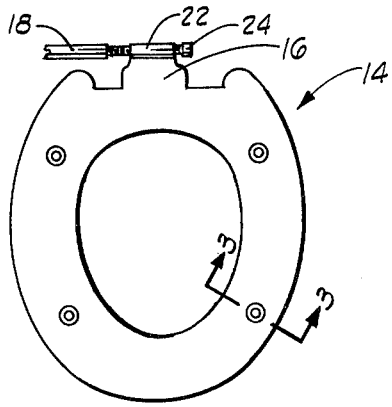
FIG. 2 is a top view of the filter connected to the vacuum pump line.

In FIG. 2 a top view of the replaceable filter 14 is shown. In this illustration the neck portion 16 of the filter 14 can be seen attached to a vacuum pump line connector 22. The connector 22 includes a cap 24 at one end with the vacuum pump line 18 connected to the other end.

Figure 3:
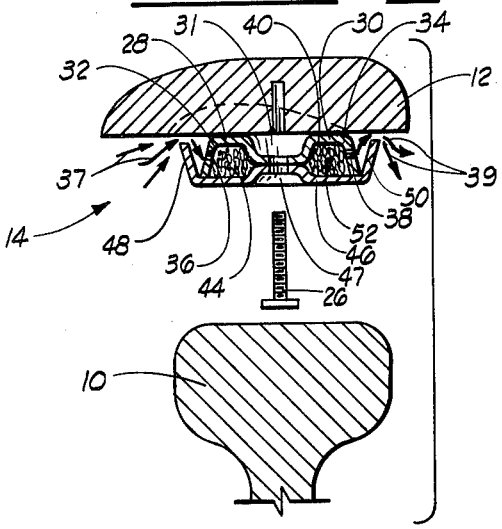
FIG. 3 is a cross-sectional view of the replaceable filter and toilet seat taken along lines 3—3 shown in FIG. 2.

In FIG. 3 a side sectional view of the replaceable filter 14 is shown taken along line 3—3 shown in FIG. 2. In this illustration the replaceable filter 14 is secured to the bottom of the seat 12 by a self-tapping screw 26. The screw 26 is received in a threaded insert placed in the seat 12. The replaceable filter 14 includes an annular shaped filter top 28 having a flat center portion 30 with an indent 31 therein for receiving the screw 26 therethrough. Integrally attached to the center portion 30 is an inner side portion 32 and an outer side portion 34. The inner side portion 32 includes intake ports 36 therearound and shown more clearly in FIG. 5 and FIG. 6. The ports 36 receive the air represented by arrows 37 from the bowl 10. Also, the outer side portion 34 includes discharge ports 38 around the outer circumference for discharging the deodorized air represented by arrows 39 from the filter 14 when the vacuum pump line 20 is not in use. The center portion 30 and side portions 32 and 34 form a cavity 40 for receiving activated charcoal 42 or the like therein. Releaseably attached to the filter top 28 is a filter bottom 44 having a flat center portion 46 with an indent 47 therein for receiving the screw 26. Integrally attached to the center portion 46 is an inner side portion 48 and an outer side portion 50 which together with the center portion 46 form a cavity 52 which is indexed with the cavity 40 formed in the filter top 28.

Figure 4:
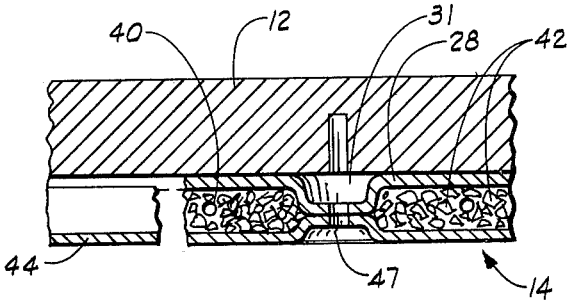
FIG. 4 is a partial sectional view of a side of the filter secured to a portion of a side of the toilet seat.

In FIG. 4 a partial side sectional view of the replaceable filter 14 is shown with the filter bottom 44 secured to the filter top 28 with the activated charcoal shown as particles 42 therein. Also shown in cross section are indents 31 and 47 for receiving the screw 26 and securing the filter bottom 44 and filter top 28 to the seat 12.

Figure 5:
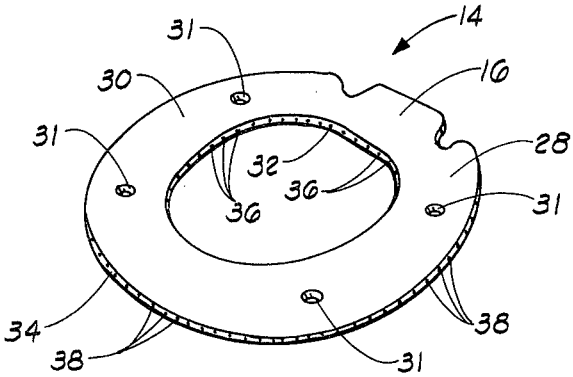
FIG. 5 is a perspective view of the filter removed from the seat.
Figure 6:
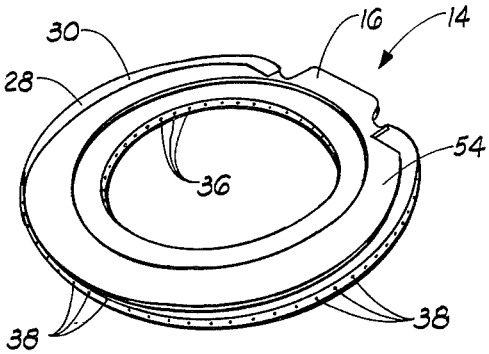
FIG. 6 is similar to the perspective view in FIG. 5 but including a gasket secured to the top thereof for providing a seal against the top of the toilet seat.

In FIG. 5 a perspective view of the replaceable filter 14 is shown with the intake ports 36 and discharge ports 38 shown therearound. In FIG. 6 the replaceable filter 14 is shown again with a gasket 54 disposed on top of the center portion 30 of the filter top 28. The gasket 54 provides a seal between the filter 14 and the bottom of the seat 12. When an elongated toilet bowl using an open-end type of seat is used, the filter 14 will be "U" shaped to conform to the seat and the vacuum 20 will be connected to the rear of the filter 14.

Figure 7A:
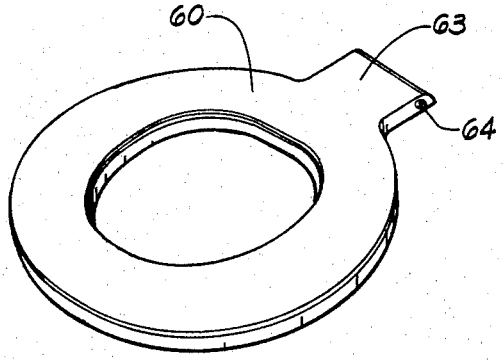
FIGS. 7A, 7B and 7C illustrate the replaceable filter in a perspective view and adapted for receipt in a molded toilet seat having a hollowed out bottom portion.
Figure 7D:
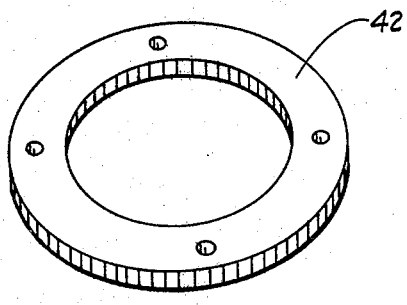
FIG. 7D illustrates an annular shaped package of activated charcoal which may be used for receipt inside the cavity of the replaceable filter.
Figure 7C:
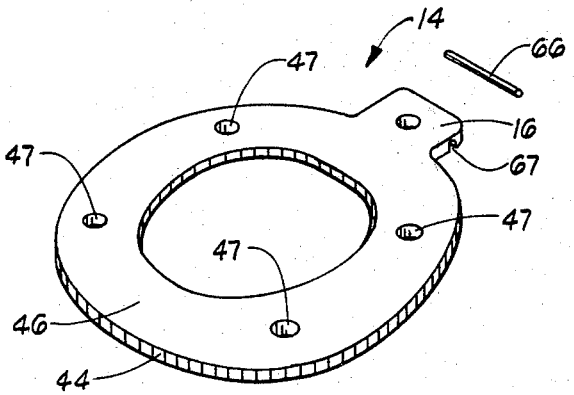
Figure 8A:
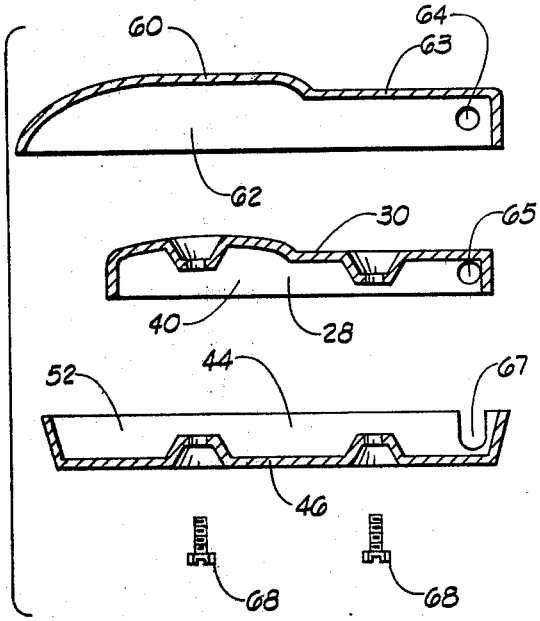
FIG. 8A is an exploded side sectional view of the molded seat and replaceable filter taken at the rear of the seat and filter where the seat is hinged to the top of the toilet bowl.

In FIG. 7A an alternate embodiment of the replaceable filter 14 is illustrated wherein a molded toilet seat 60 is shown with a hollowed out portion 62 shown in FIG. 8A in the bottom of the seat 60. The seat 60 also includes a neck portion 63 which is hollowed out and includes apertures 64 on both sides of the neck portion 63 for receiving a pin 66 shown in FIG. 7C. The pin 66 is used for hingeable attachment of the seat 60 and the filter 14 to the top of the toilet bowl 10.

Figure 7B:
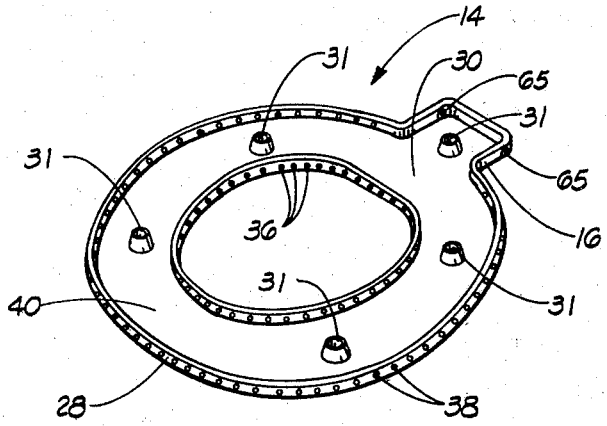

In FIG. 7B the filter top 28 is shown in an upsidedown position for illustrating the indents 31 inside the cavity 40 of the filter top 28. Also seen around the inner circumference of the top 28 are the intake ports 36 and ports around the outer circumference of the top 28 are discharge ports 38. The neck portion 16 of the top 28 also includes apertures 65 for receiving the pin 66 therethrough.

Figure 8B:
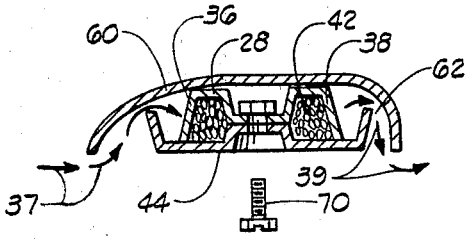
FIG. 8B is a side sectional view of the replaceable filter received in the hollowed out portion of the molded toilet seat.

In FIG. 7C the filter bottom 44 is also shown in an upsidedown position to illustrate the flat surface of the center portion 46 along with the indents 47 therein which mate with the indents 31 of the filter top 28 as shown in FIG. 3 and FIG. 8B. The neck portion 16 of the filter bottom 44 includes slots 67 on both sides thereof for receiving the pin 66 therethrough.

FIG. 7D illustrates the activated charcoal 42 in a packaged form for inserting inside the cavity of the filter 14.

It should be noted that when the seat 60 is connected to vacuum pump 20 the top 28 would not include discharge ports 38.

In FIG. 8A a cross-section of the seat 60 and neck 62 of the molded seat 66 is shown along with a cross-section of the filter top 28 and filter bottom 44 shown in a position for receipt in the hollowed out portion 62 of the seat 60. The filter top 28 is integrally mounted inside the hollowed out portion 62 of the seat 60 with the filter bottom 44 designed for releaseable attachment to the filter top 28 by screws 68.

In FIG. 8B a different cross-sectional view of the molded seat 60, filter top 28 and filter bottom 44 is shown with the filter top 28 and filter bottom 44 received in the hollowed out portion 62 of the molded seat 60 and in position for receiving a screw 70 which releaseably attaches the filter bottom 44 to the filter top 28. Also shown in this Figure is the air from the toilet bowl 10 and represented by arrows 37 received in the intake port 36 of the filter top 28 and discharged outwardly through the discharge ports 38 when the air has been deodorized by the activated charcoal 42. The deodorized air is shown as arrows 39. While discharge ports 38 are shown, the seat 60 and filter 14 could also have the vacuum line 18 connected to the neck portion 63 of the seat 60 for drawing a vacuum therein and in this case the ports 38 would not be required.

Changes may be made in the construction and arrangement of the parts or elements of the embodiments as described herein without departing from the spirit or scope of the invention defined in the following claims.

What is claimed is:

1. A replaceable filter having activated charcoal or the like therein for deodorizing the air from a toilet bowl, the filter secured to the toilet seat and providing a seal between the seat and the top of the bowl, the filter comprising:

an annular shaped filter top having a cavity formed therein and adapted for attachment to the bottom of the toilet seat;

an annular shaped filter bottom having a cavity formed therein, the filter bottom releaseably attached to the filter top with the cavity of the filter top index with the cavity of the filter bottom for receiving and holding the activated charcoal therein, the filter bottom disposed on top of the toilet bowl when the toilet seat is in a lowered position;

intake ports disposed around the inner circumference of the filter top for receiving the air from the toilet therethrough; and means for discharging the deodorized air from the cavity of the filter top and the filter bottom.

2. The filter as described in claim 1 wherein the means for discharging the deodorized air is discharge ports disposed around the outer circumference of the filter top.

3. The filter as described in claim 1 wherein the means for discharging the deodorized air is a vacuum pump line communicably connected to the cavity of the filter top and filter bottom.

4. A replaceable filter having activated charcoal or the like therein for deodorizing the air from the toilet bowl, the filter secured to the toilet seat and providing a seal between the seat and the top of the bowl, the filter comprising:

an annular shaped filter top having a flat center portion disposed against and adapted for attachment to the bottom of the toilet seat and an inner side portion and an outer side portion integrally attached to the center portion and extending downwardly therefrom, the center portion and side portions forming a cavity therein;

an annular shaped filter bottom having a flat center portion disposed against the top of the toilet bowl when the toilet seat is in a lowered position and an inner side portion and outer side portion integrally attached to the center portion and extending upwardly therefrom and forming a cavity therein, the cavity of the filter bottom indexed with the cavity of the filter top for receiving the activated charcoal therein, the filter bottom releaseably attached to the filter top;

intake ports disposed around the inner circumference of the inner side portion of the filter top for receiving the air from the toilet therethrough; and means for discharging the deodorized air from the filter.

5. The filter as described in claim 4 wherein the means for discharging the deodorized air is discharge ports disposed around the outer circumference of the outer side portion of the filter top.

6. The filter as described in claim 4 wherein the means for discharging the deodorized air is a vacuum line pump communicably connected to the cavity of the filter top and filter bottom.

7. A replaceable filter having activated charcoal or the like therein for deodorizing the air from the toilet bowl, the filter comprising:

a molded toilet seat adapted for hinged attached to the toilet bowl, the bottom of the seat having a hollowed out portion;

an annular shaped filter top having a cavity formed therein, the filter top adapted for receipt in the hollowed out portion of the seat and secured therein;

an annular shaped filter bottom having a cavity formed therein, the filter bottom releaseably attached to the filter top with a cavity of the filter top indexed with the cavity of the filter bottom for receiving and holding the activated charcoal therein, the filter bottom disposed on top of the toilet bowl when the toilet seat is in a lowered position;

intake ports disposed around the inner circumference of the filter top for receiving the air from the toilet therethrough; and means for discharging the deodorized air from the filter.

8. The filter as described in claim 7 wherein the means for discharging the deodorized air from the filter is a vacuum pump line communicably connected to the cavity of the filter top and filter bottom.

* * * * *